US005425588A

United States Patent [19]

Stemmle

[11] Patent Number: 5,425,588

[45] Date of Patent: Jun. 20, 1995

[54] PIVOTING PLATEN FOR USE IN PRINTING DEVICE

[75] Inventor: Denis J. Stemmle, Webster, N.Y.

[73] Assignee: Xerox Corporation, Stamford, Conn.

[21] Appl. No.: 139,786

[22] Filed: Oct. 22, 1993

[51] Int. Cl.[6] ..... B41J 11/02

[52] U.S. Cl. ..... 400/649; 400/656

[58] Field of Search ..... 400/648, 649, 656, 657, 400/659, 355, 356, 358, 120.16, 120.17

[56] References Cited

U.S. PATENT DOCUMENTS

| | | | |
|---|---|---|---|
| 4,476,496 | 10/1984 | Thaler | 358/286 |
| 4,823,195 | 4/1989 | Ito | 358/285 |
| 4,920,421 | 4/1990 | Stemmle | 358/296 |
| 5,032,922 | 7/1991 | Stemmle | 358/296 |
| 5,040,074 | 8/1991 | Stemmle | 358/296 |
| 5,049,999 | 9/1991 | Stemmle | 358/296 |
| 5,077,614 | 12/1991 | Stemmle et al. | 358/296 |
| 5,153,736 | 10/1992 | Stemmle | 358/296 |
| 5,162,916 | 11/1992 | Stemmle et al. | 358/296 |
| 5,187,588 | 2/1993 | Stemmle | 358/296 |

*Primary Examiner*—David A. Wiecking
*Attorney, Agent, or Firm*—Oliff & Berridge

[57] ABSTRACT

A pivoting platen for use with a printhead of a printing device includes a rigid portion and a compressible portion. The compressible portion contacts a sheet, which is pressed against the compressible portion by the printhead. The platen pivots about a rotational axis as the printhead scans across the sheet, creating uniform pressing forces between the printhead and the platen. These uniform pressing forces ensure uniform density of the image bands printed by the printhead.

16 Claims, 3 Drawing Sheets

PIVOTING PLATEN FOR USE IN PRINTING DEVICE

CROSS REFERENCE TO RELATED APPLICATIONS

This application is related to the following applications, all filed concurrently with this application and commonly assigned to the Assignee of this application:

1) U.S. patent application Ser. No. 08/139,776, entitled "RIBBON CARTRIDGE," to Babler and Stemmle;

2) U.S. patent application Ser. No. 08/139,783, entitled "PORTABLE COPIER AND METHOD OF USING A PORTABLE COPIER," to Stemmle and Babler; and 3) U.S. patent application Ser. No. 08/139,773, entitled Split-Spline Hub and Latch Mechanism.

The disclosures of these applications are incorporated herein by reference.

BACKGROUND OF THE INVENTION

1. Field of the Invention

The invention relates to platens, and more particularly to pivoting platens for use in thermal or impact printing devices such as printers, copiers, typewriters and facsimile machines, and more particularly in portable printing devices having a printing device mounted on a carriage, for printing in bands as the carriage is scanned across a copy sheet.

2. Description of Related Art

Ink transfer technology in plain paper printing devices, such as, for example, printers, copiers, typewriters and facsimile machines, is well known. FIG. 1 illustrates a known application, in which fixed-position thermal printhead 30 extends across the full width of sheet 20, which extends into and out of the plane of the Figure. Printhead 30 includes a line of resistors 35, located remote from the edge of the thermal printhead 30, which selectively melt ink on ribbon 25 to form images on sheet 20. Printhead 30 is referred to as a full-width printhead because it extends across the full width of a sheet. Full-width printheads print on a sheet without being moved back and forth across the sheet width.

Low durometer elastomer roll 10 presses ribbon 25 into close contact with resistors 35 and presses sheet 20 into close contact with ribbon 25, ensuring that sheet 20 and ribbon 25 do not slip relative to each other. Roll 10 is driven to rotate in the direction of arrow 15 to advance sheet 20 and ribbon 25 lengthwise past printhead in the direction of arrows 23 and 28, respectively so that printing can occur on the entire length of the sheet.

To achieve uniform image density along the entire width of sheet 20, the pressing forces that compress paper 20 and ribbon 25 between roll 10 and printhead 30 are uniform along the entire width of sheet 20. This is accomplished easily because the surface of printhead 30 that contacts the ribbon is flat and stationary and the pressing roller 10 contains a compressible elastomeric surface.

FIGS. 2–3 illustrate another known application, a variant of which is used in the Citizen PN48 Notebook Printer. This application uses a carriage-type print system in which a printhead containing a line of resistors reciprocates across a sheet to print images in bands on the sheet. The line of resistors are arranged approximately perpendicular to the direction in which the carriage reciprocates. Due to the scanning movement of the carriage, it can be more difficult to maintain uniform pressing forces between the printhead, ribbon and sheet, and, consequently, more difficult to maintain uniform image density across the line of resistors. In the FIG. 2–3 arrangement, thermal printhead 60 scans in scan direction 55 across stationary sheet 80 to produce successive image bands on sheet 80. A line of resistors 70, disposed near the edge of thermal printhead 60, melts ink on ribbon 75 to produce each image band. Ribbon 75 is fed between ribbon supply and take-up rolls 45, which move in direction 55 with printhead 60. After receiving each image band, sheet 80 advances into a proper position for receiving a successive image band.

Spring 65 biases printhead 60 about pivot 63 to press ribbon 75 and sheet 80 against platen 93. Platen 93 includes flat, flexible spring support 90, which supports elastomer pad 85. Spring support 90 is non-rigid, that is, it is designed to be bent or twisted without exceeding the yield point of the material from which it is formed, usually spring steel. Raised bead 98 extends from frame 95 and supports platen 93 for twisting, pivotal movement as printhead 60 scans across sheet 80. The twisting and pivoting of platen 93 on bead 98 accommodates misalignments between printhead 60 and platen 93. Accommodating such misalignments equalizes the pressing forces between printhead 60 and platen 93 across the entire width of printhead 60, resulting in image bands of uniform image density.

The pivoting platen arrangement of FIGS. 2–3 may be suitable when the width of the printhead (which corresponds to the length of the line of resistors) is small, for example, 4 mm in the Citizen PN48 Notebook Printer mentioned earlier. Such a short length, however, requires a large number of carriage reciprocations to print a single sheet of size 8½ by 11", for example. It is desirable to use wider carriage-type printheads that print wider image bands, and therefore do not require a large number of reciprocations to print a single sheet. This increases print speed, reduces carriage wear (because fewer reciprocations are necessary), and increases the number of pages that can be printed using a roll of ribbon, without increasing the diameter of the roll. For example, the portable copier described in the related U.S. patent applications incorporated by reference above, uses a printhead that prints image bands 24.38 mm wide.

The printing platen arrangement of FIGS. 2–3 has a number of disadvantages when used with wider printheads. In particular, it becomes difficult to insure uniform pressing forces at ends of the printhead. Platen 93 would have to be substantially modified to function properly, i.e., to create uniform pressing forces and thereby ensure uniform image density, in a wide-printhead printing device. Platen 93 could be modified in at least two alternative ways:

1) Vary the thickness across spring support 90 and/or elastomer pad 85, so that the thickness of each is non-uniform. Varying the cross-sectional thickness of support 90 and/or pad 85 would be designed to cause pressing forces at extreme outboard contact points between the printhead and the platen to match pressing forces at the center of the printhead. Such a design, however, would be expensive and difficult to implement due to high manufacturing tolerances that would be required.

2) Design spring support 90 and/or elastomer pad 85 to curl in their relaxed states, so that outboard portions of the printhead would deflect spring support 90 farther at outboard contact points than at central contact points. Such curvature, however, would create at least two problems. First, a curved design would greatly increase manufacturing costs. Second, a curved design would complicate loading a sheet into proper position between the ribbon and the curved platen. Inserting sheets through a space defined by a curved platen on one side and a flat printhead covered by ribbon on the other side would be quite difficult and present an unacceptably high possibility of misfeed.

Because the platen of FIGS. 2–3 and its modifications are unacceptable for wide-band printing devices, as described above, a need has arisen to develop a platen that more efficiently and effectively promotes uniform density of images printed by such printing devices.

SUMMARY OF THE INVENTION

To overcome these and other disadvantages of the prior art, a printing device constructed according to the invention includes a printhead for printing on a sheet, a platen against which the sheet is pressed by pressing forces, and a pivot member disposed on a rigid portion of the platen and supporting the platen for rotation about an axis, wherein the platen can rotate about the axis as the printhead moves across the sheet so that the pressing forces are uniform across a width of the printhead. The pivot member preferably includes a pivot ridge extending in the scan direction and supporting the platen for rotation within the printing device, and a frame member of the printing device preferably receives and supports the pivot ridge.

The rigid portion of the platen preferably includes a substantially flat plate. A biasing member preferably biases the printhead toward the platen and the sheet with the pressing forces. A compressible portion of the platen is preferably supported by the rigid portion of the platen, the compressible portion contacting the sheet.

According to another aspect of the invention, a printing device includes a platen and a printhead for printing on a sheet, the printhead and platen being biased toward each other to press the sheet between them. The platen preferably includes a substantially flat plate that pivots about a rotation axis without bending. The flat plate is preferably rigid, and the platen preferably includes a compressible member that contacts the sheet. The printing device preferably includes a frame member that receives a pivot ridge on the flat plate.

According to another aspect of the invention, a platen for use in a printing device supports a sheet on which a printhead prints, the platen preferably including a flat plate and a compressible, elastomeric member attached to a first side of the plate. At least one support member is provided at first and second opposite ends of the flat plate, the support member preferably including a pivot ridge on the flat plate. A biasing member biases the platen and the printhead toward each other so that the sheet is sandwiched between the platen and the printhead. The biasing member is preferably a spring that biases the printhead against the platen. The platen rotates about the rotation axis as the printhead moves in a scan direction across the sheet so that pressing forces between the printhead and the platen are uniform across a width of the printhead.

These and other features of the invention are described in or apparent from the following detailed description of preferred embodiments.

BRIEF DESCRIPTION OF THE DRAWINGS

Preferred embodiments are described with reference to the drawings, in which like reference numerals denote like elements throughout the Figures, and in which.

DETAILED DESCRIPTION OF PREFERRED EMBODIMENTS

The disclosed platen can be used with a thermal printhead in a portable copier, such as disclosed in the related applications incorporated by reference above and in U.S. Pat. No. 5,187,588 to Denis J. Stemmle, the disclosure of which is incorporated herein by reference. The platen also can be used in other printing devices, such as typewriters, printers, facsimile machines, etc. Further, the disclosed platen need not be used in thermal printing devices that use thermally sensitive ink ribbons, but also could be used in thermal printing devices that use thermally sensitive paper and no ribbon. The invention also is applicable to impact-type or other printing devices. Thus, while preferred embodiments of the invention will be described, the invention is not limited to those embodiments.

Figure 4:
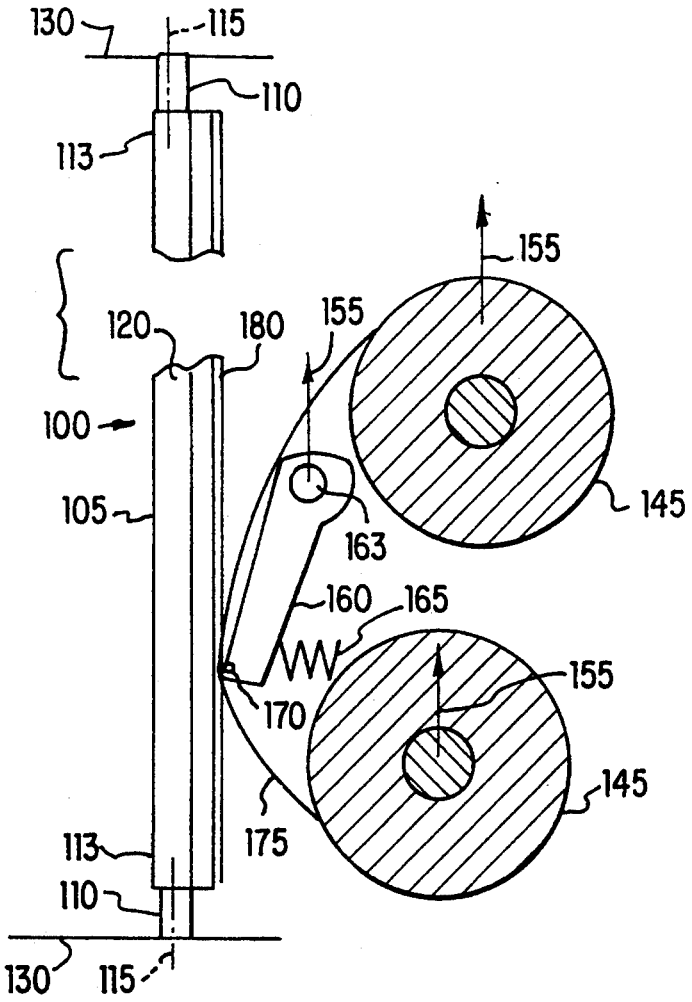
FIG. 4 is a bottom view of a scanning printhead and pivoting platen according to the invention.
Figure 5:
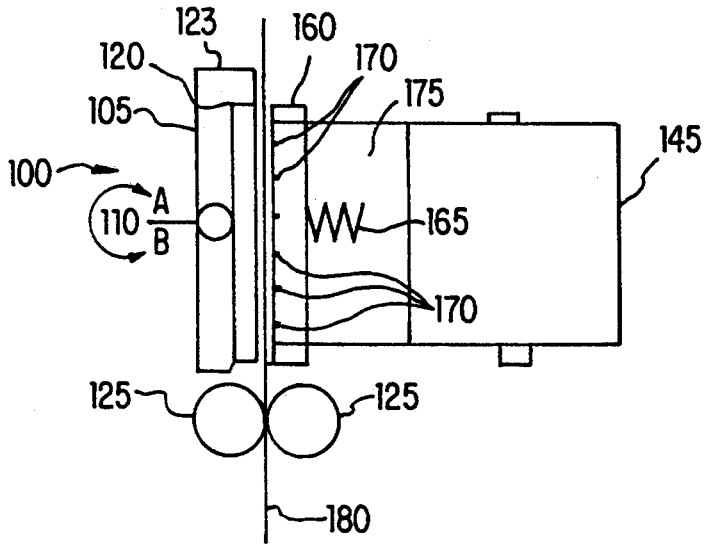
FIG. 5 is a side view of the FIG. 4 device.

FIGS. 4–5 illustrate a printing device according to the invention. Printhead 160 prints image bands on a first side of sheet 180 as printhead 160 scans across sheet 180 in scan direction 155. Printhead 160, preferably a thermal printhead, includes a line of resistors 170 that transfer ink from ribbon 175 to sheet 180. Ribbon 175 is preferably a thermal ribbon fed between supply and take-up rolls 145, which move in direction 155 along with the carriage containing printhead 160. Alternatively, as described above, other ribbons (or no ribbons, when thermally sensitive paper is used, for example) and printheads, such as pressure-sensitive ink ribbons and impacttype printheads, can be used.

After each scan, that is, after printhead 160 produces each image band on sheet 180, rollers 125 advance sheet 180 into position for receiving a successive image band. Alternatively, rollers 125 advance sheet 180 out of the printing device when all the scans for that sheet are completed.

Further details on the mechanisms for moving the carriage supporting printhead 160 and for moving sheet 180 (as well as for moving a document sheet for reading an original image therefrom when printhead 160 is included in a portable copier) are provided in U.S. patent application No. 08/139,783, incorporated by reference above.

Extending in scan direction 155 for the entire width of sheet 180, and opposed to printhead 160 is platen 100. Platen 100 includes compressible portion 120, preferably an elastomer pad having a substantially flat contact area that contacts a second side of sheet 180, opposite the first side of sheet 180 on which images are printed.

Biasing member 165, preferably a spring, biases printhead 160 about pivot 163 to press ribbon 175 against sheet 180 and sheet 180 against platen 100.

Platen 100 also includes rigid portion 105, which is preferably a substantially flat plate, that is, a plate with at least one substantially flat surface. Rigid portion 105 does not substantially bend or twist, that is, it is not designed to be bent or twisted without exceeding the yield point of the material from which it is formed. This is in distinction to spring support 90 of prior art FIGS. 2–3, which readily bends and twists. Rigid portion 105 is entirely flat except for lip 123, which is optionally provided for guiding the leading edge of copy sheet 180 across compressible portion 120 during initial sheet insertion between ribbon 175 and platen 100. Rigid portion 105 supports compressible portion 120 and has two ends 113. In this embodiment, each end supports a pivot member or support member 110, which is preferably a pivot pin extending parallel to scan direction 155 and defining platen rotation axis 115. Rotation axis 115 is contained, at all times, within the plane of rigid portion 105. This differs from the arrangement shown in FIGS. 2–3, in which a surface of the platen pivots on a bead or ridge.

Pivot member 110 supports platen 100 on printing device frame 130. As printhead 160 scans across sheet 180 in scan direction 155, platen 100 can pivot on frame 130, about rotation axis 115, in the direction of arrow A-B in FIG. 5, to accommodate platen-printhead misalignment. Thus, for example, when one side of printhead 160 contacts an outboard portion of platen 100 before the center portion or the other outboard portion of platen 100 is contacted, platen 100 pivots about rotation axis 115, resulting in uniform pressing forces between printhead 160 and platen 100.

Figure 6:
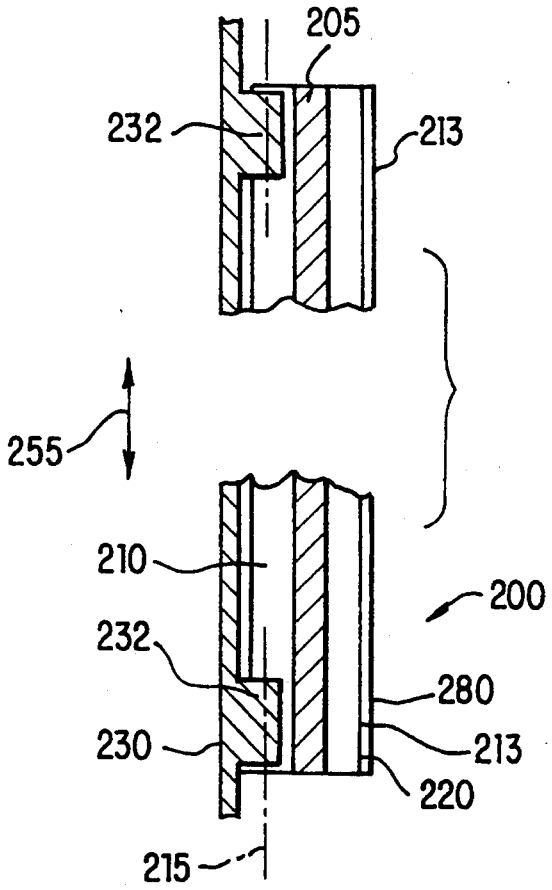
FIG. 6 is a bottom view of a pivoting platen according to an alternate embodiment of the invention.
Figure 7:
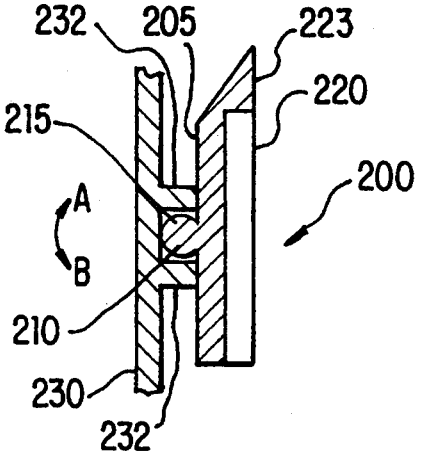
FIG. 7 is a side view of the FIG. 6 device.

FIGS. 6–7 illustrate an alternate platen embodiment according to the invention.

Extending in scan direction 255 for the entire width of sheet 280, and opposed to a printhead (not shown in FIGS. 6–7, but like printhead 160 of FIGS. 4–5), is platen 200. Platen 200 includes compressible portion 220, preferably an elastomer pad having a substantially flat contact area that contacts a second side of sheet 280, opposite the first side of sheet 280 on which images are printed. The printhead biases sheet 280 against platen 200 as in the embodiment of FIGS. 4–5.

Platen 200 also includes rigid portion 205, which is preferably a substantially flat plate, that is, a plate with at least one substantially flat surface. Rigid portion 205 does not substantially bend or twist, that is, it is not designed to be bent or twisted without exceeding the yield point of the material from which it is formed. This is in distinction to spring support 90 of prior art FIGS. 2–3, which readily bends and twists. Rigid portion 205 includes lip 223, which is optionally provided for guiding the leading edge of copy sheet 280 across compressible portion 220 during initial sheet insertion between the ribbon and platen 200. Rigid portion 205 supports compressible portion 220 and has two ends 213. In this embodiment, rigid portion 205 also includes pivot member or support member 210, which is preferably a raised pivot ridge integral with rigid portion 205. Support member 210 extends parallel to scan direction 255 and defines platen rotation axis 215.

Flanges 232 of printing device frame 230 receive support member 210 of platen 200 at opposite platen ends 213, supporting platen 200 for pivotal movement in the direction of arrow A-B in FIG. 7. As the printhead scans across sheet 280 in scan direction 255, platen 200 can pivot on frame 230, about rotation axis 215, to accommodate platen-printhead misalignment. Thus, for example, when one side of the printhead contacts an outboard portion of platen 200 before the center portion or the other outboard portion of platen 200 is contacted, platen 200 pivots about rotation axis 215, resulting in uniform pressing forces between the printhead and platen 200.

Figure 1:
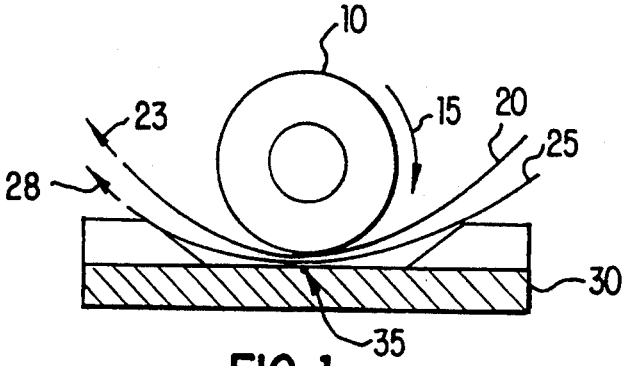
FIG. 1 PRIOR ART
FIG. 1 is a side view of an elastomer roll and a fixed, full-width printhead in a known thermal printing device.
Figure 2:
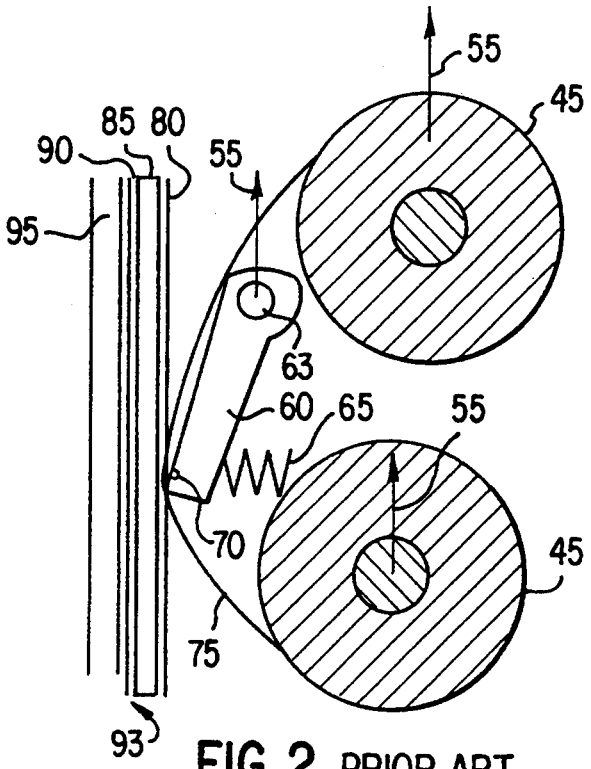
FIG. 2 PRIOR ART
FIG. 2 is a top view of a scanning printhead and pivoting platen in a known thermal printing device.
Figure 3:
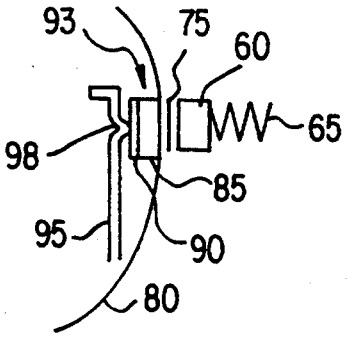
FIG. 3 PRIOR ART
FIG. 3 is a side view of the FIG. 2 printer.

Like the known device of FIGS. 2–3, platen movement according to embodiments of the invention accommodates printhead-platen misalignment and promotes uniform image density. Unlike the prior art, however, the platen according to the invention can be used with a printhead that creates much wider image bands, without requiring undesirable designs and high manufacturing tolerances.

Because the surfaces of compressible portions 120, 220 that contact sheets 180, 280 are flat in lines extending perpendicular to scan directions 155, 255, uniform pressing forces between printhead and the platen, and thus uniform image density, are achieved. Conventional methods of fabrication, therefore, such as extrusion or molding, can be used to form compressible portions 120, 220 and rigid portions 105, 205, lowering design and manufacturing costs.

While the invention has been described with reference to specific embodiments, the description is illustrative and is not to be construed as limiting the scope of the invention. For example, in some applications it may not be necessary to include the compressible portion 120, 220 on the rigid portion 105, 205. Absence of a compressible portion could be used to reduce the pressing forces between the printhead and platen. Various other modifications and changes may occur to those skilled in the art without departing from the spirit and scope of the invention defined in the appended claims.

What is claimed is:

1. A printing device, comprising:

a printhead for printing on a first side of a sheet, said printhead being movable across the sheet in a scan direction;

a platen extending in the scan direction and opposed to said printhead, said platen for contacting a second side of the sheet opposite from said first side of the sheet, the sheet being pressed against the platen by pressing forces between the printhead and the platen, the platen comprising a rigid plate that extends in the scan direction and includes a substantially flat first side that faces the sheet and a second side opposite said first side; and at least one riqid pivot member, protruding from the second side of the rigid plate and supporting the platen for rotation about a constant axis extending in the scan direction, said at least one rigid pivot member located only adjacent to the second side of said rigid plate so as not to extend beyond ends of said rigid plate; and a frame member that receives and supports said at least one rigid pivot member;

wherein the platen rotates about the constant axis as the printhead moves across the sheet so that the pressing forces between the printhead and the platen are uniform across a width of said printhead.

2. The printing device of claim 1, wherein the printhead is a thermal printhead that prints on the sheet by a thermal process.

3. The printing device of claim 1, further comprising a biasing member that biases the printhead toward the platen and the sheet with said pressing forces.

4. The printing device of claim 1, wherein the platen further includes a compressible portion located on the first side of said rigid plate, said compressible portion facing the sheet.

5. The printing device of claim 1, wherein the at least one pivot member comprises a pivot ridge extending in the scan direction substantially an entire length of said rigid plate and supporting the platen for rotation within the printing device.

6. A printing device, comprising:

a printhead for printing on a first side of a sheet, said printhead being movable across the sheet in a scan direction;

a platen extending in the scan direction and opposed to said printhead, said platen for contacting a second side of the sheet opposite from said first side of the sheet, the printhead and the platen being biased toward each other to press the sheet between the printhead and the platen, the platen comprising: a rigid, substantially flat plate extending in said scan direction and having a first surface that faces the sheet, a second surface opposite said first surface, and first and second opposite ends, the plate including a first coupling member on the second surface that does not extend beyond said first and second opposite ends; and a second coupling member in said printing device and engaged with said first coupling member, said first and second coupling members being movably attached to each other to permit said flat plate to rotate about a rotation axis parallel to said scan direction, the flat plate pivoting about the rotation axis without bending, said first and second coupling members remaining in a constant position with respect to each other relative to directions perpendicular to said scan direction during rotation of said plate.

7. The printing device of claim 6, wherein the platen further comprises:

a compressible member attached to said first side of the flat plate extending between said first and second ends of the flat plate.

8. The printing device of claim 6, wherein said second coupling member is a frame member having a qroove extending in the scan direction, and said first coupling member is a pivot ridge extending in the scan direction on the flat plate so as to support the platen for rotation within the printing device, said pivot ridge located in said groove.

9. A platen for use in a printing device having a printhead that prints on a sheet as the printhead moves in a scan direction across the sheet, said platen for supporting the sheet during printing; said platen comprising:

a substantially flat, riqid plate extending in the scan direction and having first and second opposite ends and first and second opposite sides extending between said first and second opposite ends;

a compressible member attached to said first side for supporting the sheet during printing; and at least one rigid coupling member on said second surface that does not extend beyond said first and second opposite ends, said rigid coupling member permitting the flat plate to rotate about a rotation axis parallel to the scan direction without said coupling member moving in directions perpendicular to said scan direction, the flat plate rotating about the rotation axis without bending.

10. The platen of claim 9, wherein a surface of the compressible member is substantially flat.

11. The platen of claim 9, wherein said compressible member is formed of an elastomer.

12. The platen of claim 9, wherein the at least one rigid coupling member comprises a pivot ridge extending in the scan direction on the second surface of the flat plate.

13. A printing device comprising:

a printhead for printing on a first side of a sheet, said printhead being movable across the sheet in a scan direction;

a platen comprising:

a flat, rigid plate extending in the scan direction and opposed to said printhead, said flat, rigid plate having first and second opposite ends and first and second opposite surfaces extending between said first and second opposite ends;

a compressible member attached to said first surface for contacting and supporting the sheet during printing; and a first rigid coupling member on said second surface that does not extend beyond said first and second opposite ends;

a second coupling member in said printing device and engaged with said first coupling member, said first and second coupling members being movably attached to each other to permit the flat plate to rotate about a rotation axis parallel to said scan direction, said first and second coupling members remaining in a constant position with respect to each other relative to directions perpendicular to said scan direction during rotation of said flat plate;

a biasing member biasing said platen and said printhead toward each other so that the sheet is sandwiched between the platen and the printhead;

said flat, rigid plate rotating about said rotation axis as the printhead moves in the scan direction so that pressing forces applied by the biasing member between the printhead and the platen are uniform across a width of said printhead.

14. The platen of claim 13, wherein said compressible member is formed of an elastomer.

15. The platen of claim 13, wherein the first rigid coupling member comprises a pivot ridge extending in the scan direction on the second surface of said flat plate.

16. The printing device of claim 13, wherein said biasing member is a spring that biases said printhead against said platen, said printhead being movably mounted in the printing device.

* * * * *